US010804637B2

(12) United States Patent
Gonzalez Delgadillo et al.

(10) Patent No.: US 10,804,637 B2
(45) **Date of Patent: *Oct. 13, 2020**

(54) CONNECTOR-ASSEMBLY WITH PRIMARY-LOCK-REINFORCEMENT DEVICE HAVING A SHIPPING-POSITION

(71) Applicant: Aptiv Technologies Limited, St. Michael (BB)

(72) Inventors: Carlos A. Gonzalez Delgadillo, Saltillo (MX); Jorge I. Escamilla Rodriguez, Saltillo (MX); Pedro Yabur Pacheco, Saltillo (MX)

(73) Assignee: APTIV TECHNOLOGIES LIMITED (BB)

( * ) Notice: Subject to any disclaimer, the term of this patent is extended or adjusted under 35 U.S.C. 154(b) by 0 days.

This patent is subject to a terminal disclaimer.

(21) Appl. No.: 16/526,231

(22) Filed: Jul. 30, 2019

(65) Prior Publication Data

US 2020/0083631 A1 Mar. 12, 2020

Related U.S. Application Data

(63) Continuation of application No. 16/124,453, filed on Sep. 7, 2018, now Pat. No. 10,418,742.

(51) Int. Cl.
*H01R 13/426* (2006.01)
*H01R 13/506* (2006.01)
(Continued)

(52) U.S. Cl.
CPC ..... *H01R 13/426* (2013.01); *H01R 13/4365* (2013.01); *H01R 13/506* (2013.01); *H01R 13/5202* (2013.01); *H01R 13/5208* (2013.01)

(58) Field of Classification Search
CPC ..... H01R 13/426; H01R 13/4365; H01R 13/506; H01R 13/5202; H01R 13/5208
See application file for complete search history.

(56) References Cited

U.S. PATENT DOCUMENTS 5,538,445 A * 7/1996 Grzybowski ..... H01R 13/426 439/744
5,871,373 A * 2/1999 Pacini ..... H01R 13/4364 439/364

(Continued)

*Primary Examiner* — Truc T Nguyen
(74) *Attorney, Agent, or Firm* — Billion & Armitage; Robert Myers

(57) ABSTRACT

A connector-assembly includes a connector-housing and a primary-lock-reinforcement device. The connector-housing retains electrical-terminals within terminal-cavities defined by a terminal-tower disposed within the connector-housing. The electrical-terminals mate with one or more corresponding electrical-terminals along a mating-axis of the connector-assembly. The primary-lock-reinforcement device slideably engages the terminal-tower and is moveable from a shipping-position to a pre-stage-position. The primary-lock-reinforcement device has a base and a skirt. The primary-lock-reinforcement device has a post extending beyond an inner-surface of the skirt that engages a corresponding L-shaped slot defined by an outer-surface of the terminal-tower. The corresponding L-shaped slot has a first-leg and a second-leg. The first-leg defines a wall configured to inhibit a movement of the primary-lock-reinforcement device along the mating-axis. When the primary-lock-reinforcement device is moved from the shipping-position to the pre-stage-position, the post aligns with an entrance to the second-leg, thereby enabling the primary-lock-reinforcement device to move from the pre-stage-position to a full-stage-position.

22 Claims, 7 Drawing Sheets

(51) Int. Cl.
*H01R 13/436* (2006.01)
*H01R 13/52* (2006.01)

(56) References Cited

U.S. PATENT DOCUMENTS 5,993,255 A * 11/1999 Yurko ..... H01R 13/631
439/364
6,004,153 A * 12/1999 Myer ..... H01R 13/641
439/352
6,083,058 A * 7/2000 Fujiwara ..... H01R 13/4362
439/595
6,305,990 B1 * 10/2001 Ward ..... H01R 13/432
439/752
6,676,453 B1 * 1/2004 Rosset Rubio .... H01R 13/4362
439/752
6,786,768 B2 * 9/2004 Murakami ..... H01R 13/4365
439/271
8,449,317 B1 * 5/2013 Dang ..... H01R 13/5202
439/449
9,496,654 B2 * 11/2016 Little ..... H01R 13/6583
9,865,966 B2 * 1/2018 Matsuura ..... H01R 13/62911
2006/0063414 A1 * 3/2006 Goto ..... H01R 13/4223
439/298
2009/0269963 A1 * 10/2009 Brown ..... H01R 13/4223
439/357
2011/0045709 A1 * 2/2011 Xiong ..... H01R 13/6582
439/701
2013/0323958 A1 * 12/2013 Nakashima ..... H01R 13/6272
439/350
2015/0311633 A1 * 10/2015 Miklinski ..... H01R 13/6273
439/345
2018/0159266 A1 * 6/2018 Yu ..... H01R 12/7047

* cited by examiner

CONNECTOR-ASSEMBLY WITH PRIMARY-LOCK-REINFORCEMENT DEVICE HAVING A SHIPPING-POSITION

CROSS-REFERENCE TO RELATED APPLICATION

This is a continuation application and claims the benefit under 35 U.S.C. § 120 of U.S. patent application Ser. No. 16/124,453, filed Sep. 7, 2018, the entire disclosure of which is hereby incorporated herein by reference.

TECHNICAL FIELD OF INVENTION

This disclosure generally relates to an electrical connector-assembly, and more particularly relates to an electrical connector-assembly with a primary-lock-reinforcement device that has a shipping-position.

BRIEF DESCRIPTION OF DRAWINGS

The present invention will now be described, by way of example with reference to the accompanying drawings, in which.

DETAILED DESCRIPTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Figure 1:
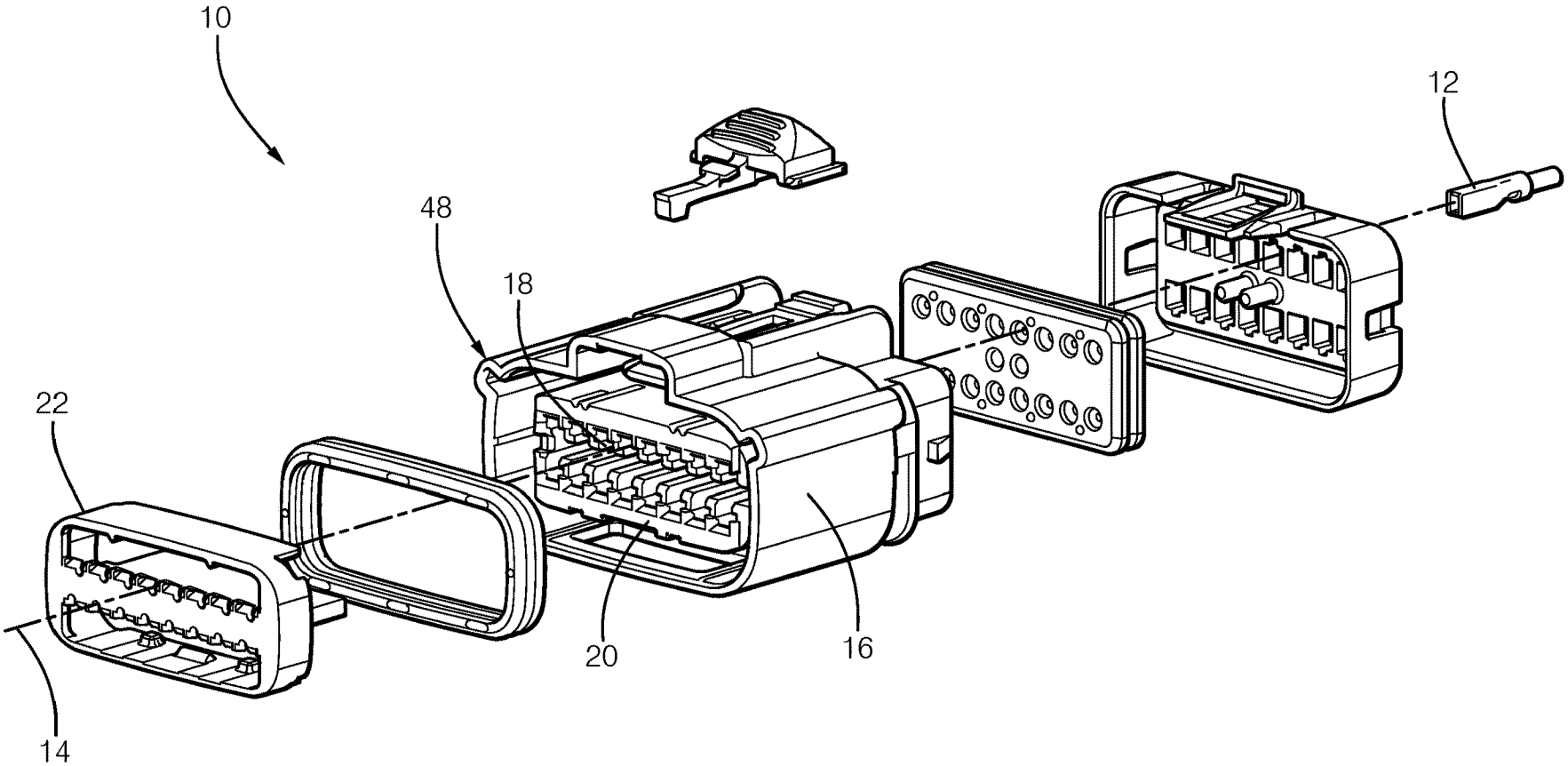
FIG. 1 is an exploded perspective view illustrating a connector-assembly in accordance with one embodiment.

FIG. 1 is an exploded view illustrating a connector-assembly 10. As will be described in more detail below, the connector-assembly 10 is an improvement over prior art connector assemblies, because the connector-assembly 10 maintains a position of its components during shipping and handling and inhibits inadvertent and/or premature movement of locking features. The connector-assembly 10 includes one or more electrical-terminals 12, hereafter referred to as the terminals 12, configured to mate with one or more corresponding electrical-terminals (not shown) along a mating-axis 14 of the connector-assembly 10. The terminals 12 are formed of an electrically conductive material, such as a copper-based alloy that may also include a coating of another conductive material (e.g. a tin-based or silver-based coating). The terminals 12 are configured to be attached to wire cables (not shown) that may be a component of a wiring-harness of a vehicle.

The connector-assembly 10 also includes a connector-housing 16 configured to retain the terminals 12 within one or more terminal-cavities 18, hereinafter referred to as terminal-cavities 18 defined by a terminal-tower 20 disposed within the connector-housing 16. The connector-housing 16 is formed of a polymeric dielectric material. The polymeric dielectric material may be any polymeric dielectric material capable of electrically isolating portions of the terminals 12, and is preferably a polyamide (NYLON) material.

The connector-assembly 10 also includes a primary-lock-reinforcement device 22 (PLR-device 22) configured to slideably engage the terminal-tower 20. The PLR-device 22 is preferably formed of the same polymeric dielectric material as the connector-housing 16, but may be any polymeric dielectric material. The PLR-device 22 is moveable from a shipping-position 24 to a pre-stage position 26, as will be explained in more detail below.

Figure 2A:
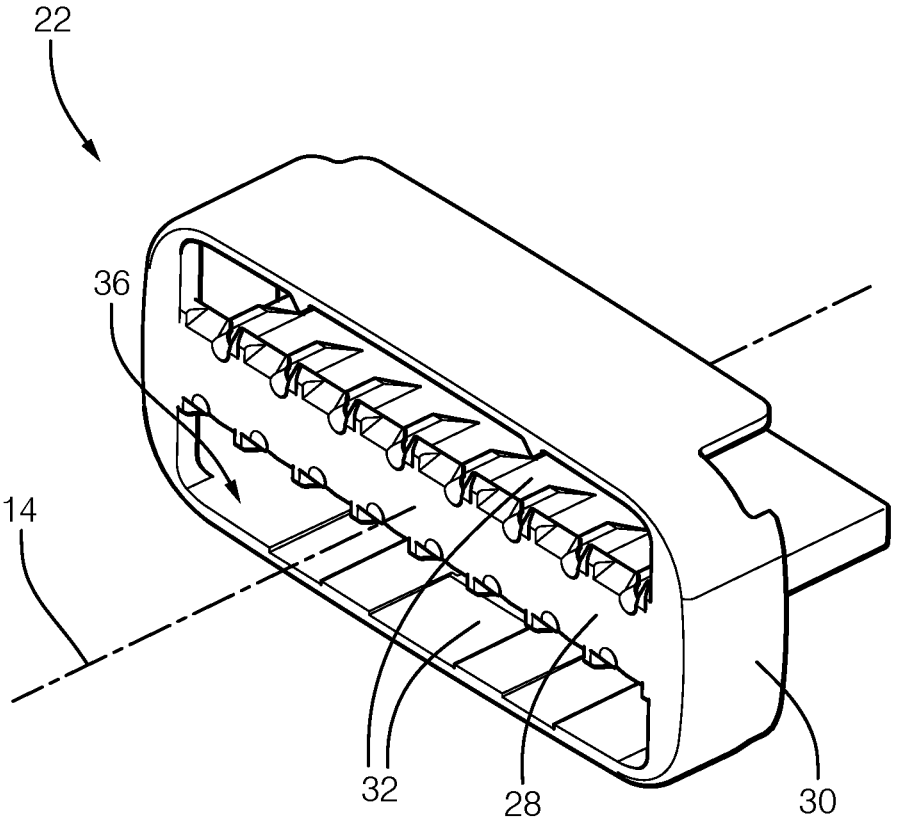
FIG. 2A is a perspective end-view of a primary-lock-reinforcement device isolated from the assembly of FIG. 1 in accordance with one embodiment.
Figure 2B:
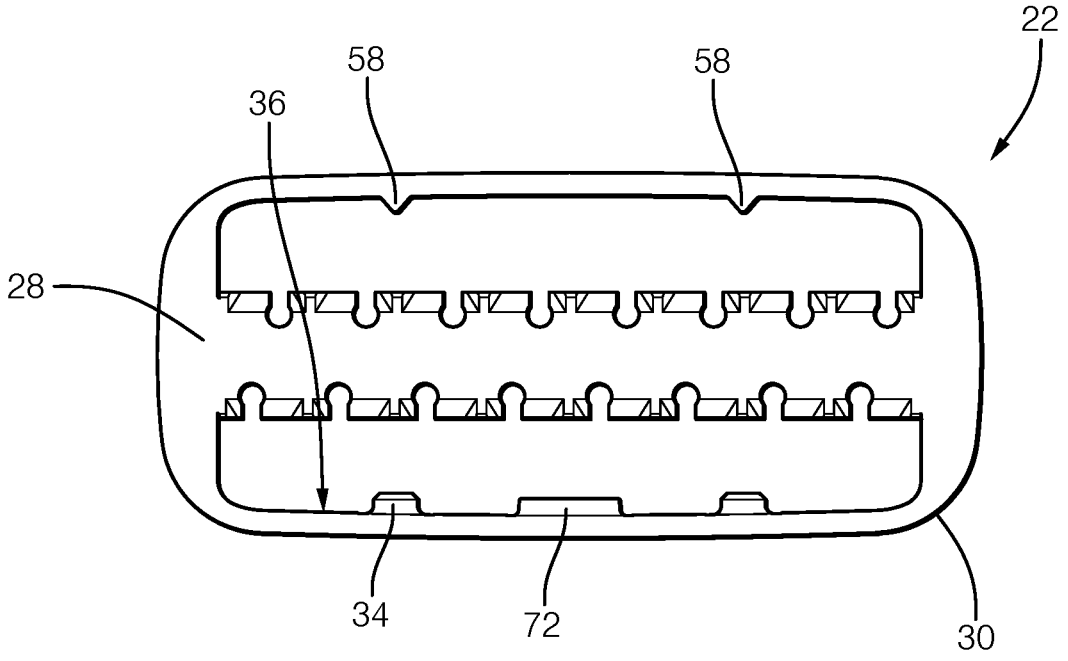
FIG. 2B is an end-view of the primary-lock-reinforcement device of FIG. 2A in accordance with one embodiment.

FIGS. 2A-2B illustrate the PLR-device 22 isolated from the connector-assembly 10 of FIG. 1. As illustrated in FIG. 2A, the PLR-device 22 has a base 28 and a skirt 30 extending beyond the base 28 along the mating-axis 14. The base 28 defines one or more apertures 32, hereafter referred to as the apertures 32, through which the corresponding electrical-terminals pass. As illustrated in FIG. 2B, the PLR-device 22 has a post 34 extending beyond an inner-surface 36 of the skirt 30. In one embodiment, the PLR-device 22 includes a single post 34. In the embodiment illustrated in FIG. 2B, the PLR-device 22 includes a plurality of posts 34 having a generally square-shape. In another embodiment, the posts 34 have a generally cylindrical-shape. The posts 34 are configured to engage a corresponding L-shaped slot 38 defined by an outer-surface 40 of the terminal-tower 20, as will be described in more detail below.

Figure 3:
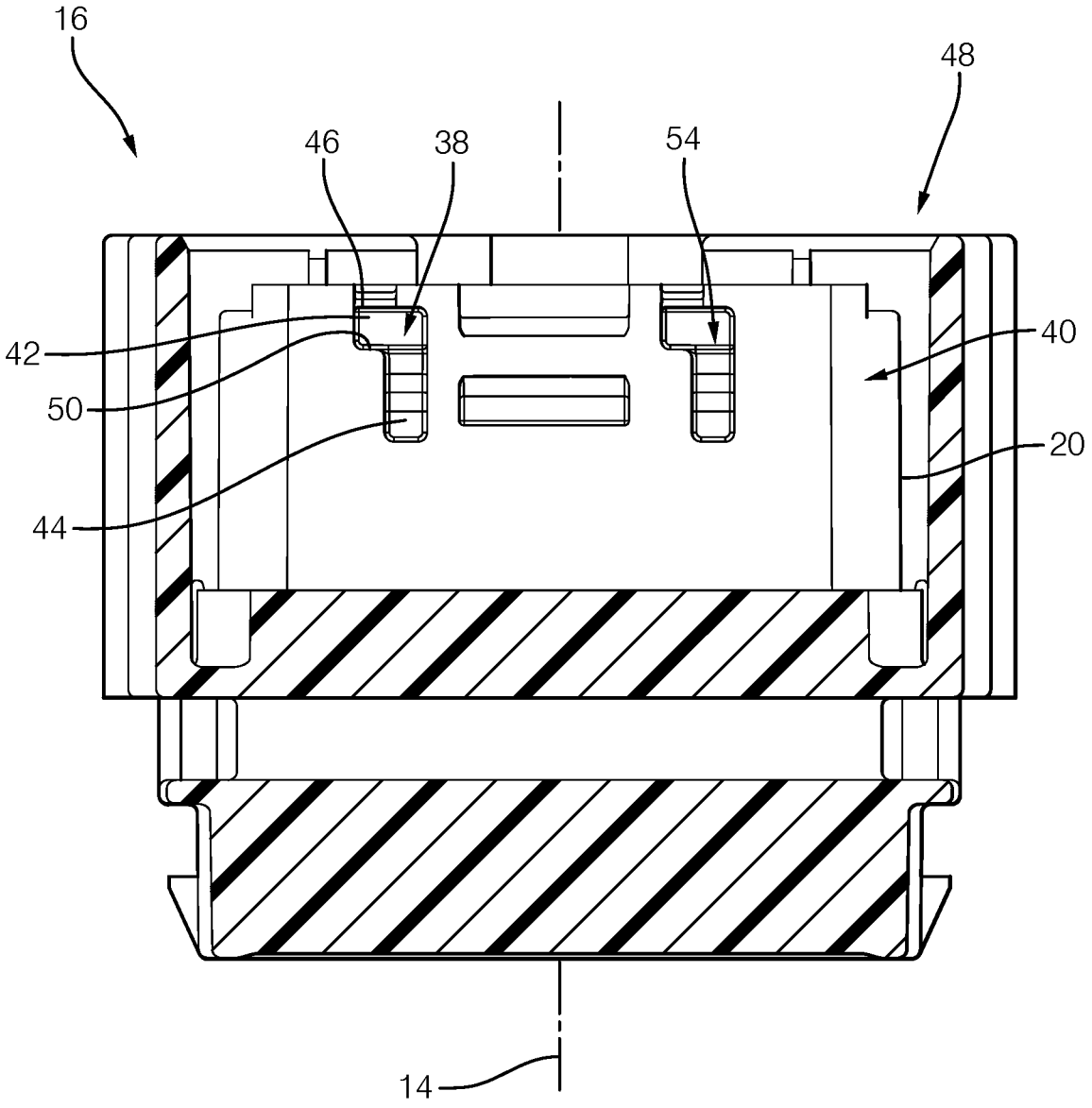
FIG. 3 is a section view of a connector-housing of the connector-assembly of FIG. 1 in accordance with one embodiment.

FIG. 3 is a section view of the connector-housing 16 illustrating the L-shaped slot 38. The L-shaped slot 38 has a first-leg 42 and a second-leg 44. The first-leg 42 defines a stop 46 configured to inhibit a removal of the PLR-device 22 from the terminal-tower 20 when the PLR-device 22 is in the shipping-position 24 (see FIG. 4A). That is, the post 34 on the PLR-device 22 is retained by the stop 46 and inhibits the PLR-device 22 from being moved away from a terminal-end 48 of the connector-housing 16. The first-leg 42 further defines a wall 50 configured to inhibit a movement of the PLR-device 22 along the mating-axis 14 and maintains the PLR-device 22 in the shipping-position 24. In other words, the PLR-device 22 is held in the shipping-position 24 with the post 34 retained between the stop 46 and the wall 50, permitting only movement in a lateral-direction 52 toward a centerline of the connector-housing 16. For the purposes of illustration, the centerline of the connector-housing 16 is shown as the mating-axis 14 in FIG. 3.

Figure 4B:
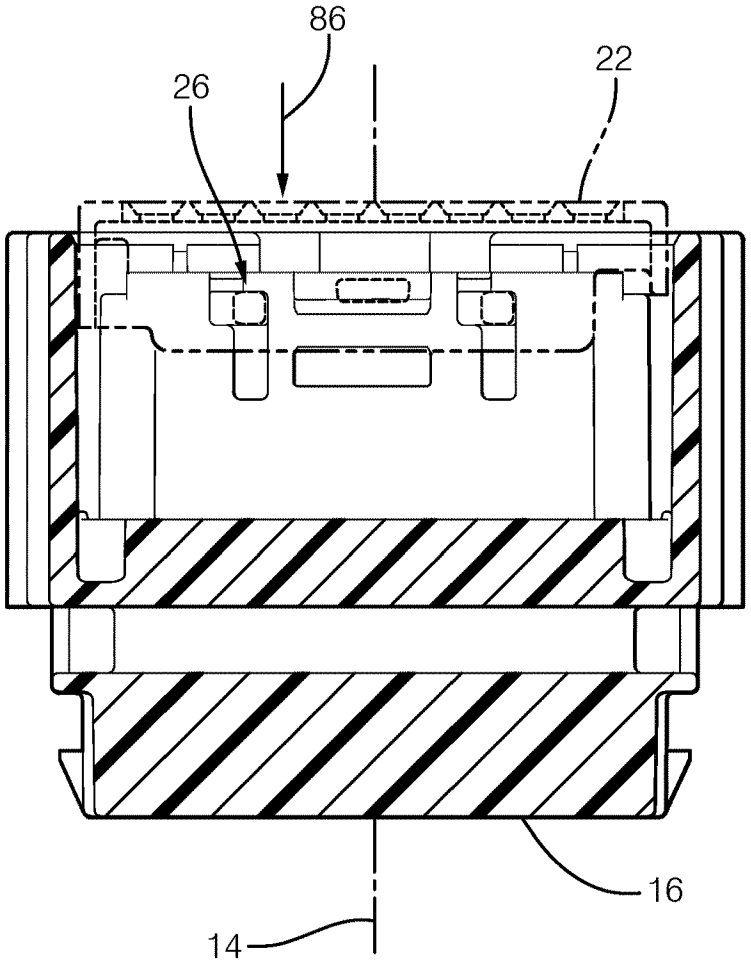
FIG. 4B is another section view of the connector-housing and the primary-lock-reinforcement device of FIG. 1 in accordance with one embodiment.
Figure 4A:
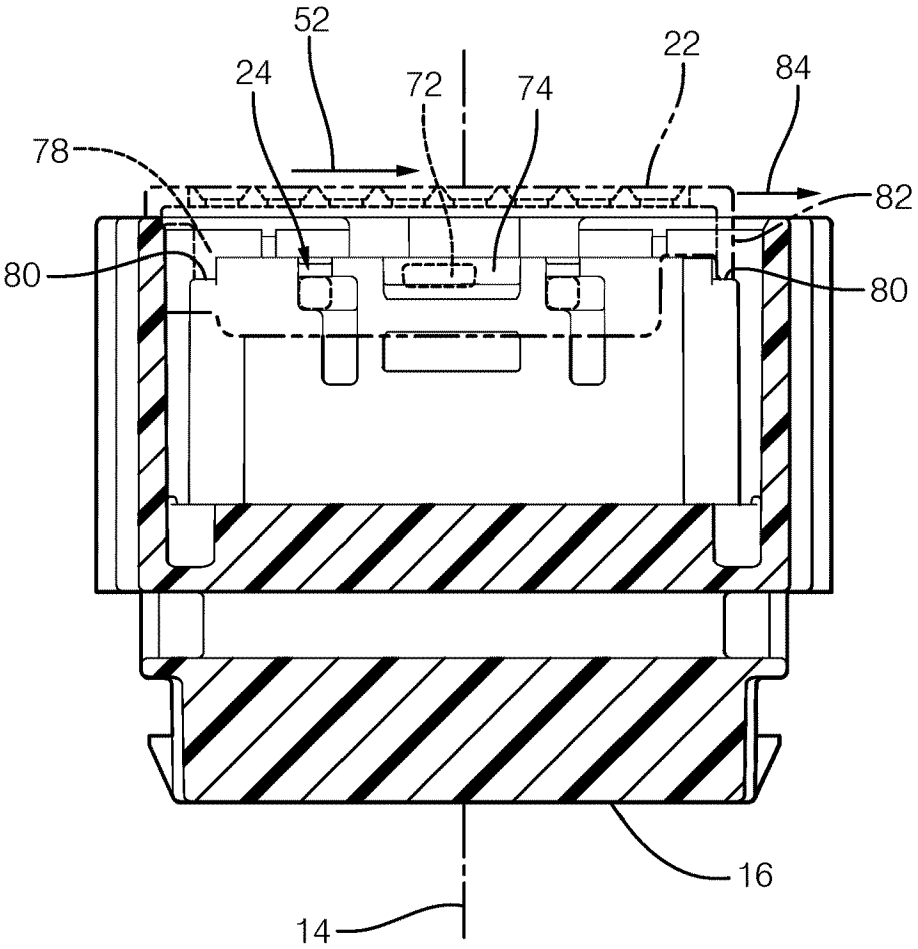
FIG. 4A is a section view of the connector-housing and the primary-lock-reinforcement device of FIG. 1 in accordance with one embodiment.

FIGS. 4A-4B illustrate an interaction between the post 34 and the L-shaped slot 38 when the PLR-device 22 is moved in the lateral-direction 52 from the shipping-position 24 (FIG. 4A) to the pre-stage position 26 (FIG. 4B). The post 34 aligns with an entrance 54 (see FIG. 3) to the second-leg 44, thereby enabling the PLR-device 22 to move from the pre-stage position 26 to a full-stage position 56 (see FIG. 5).

Figure 6:
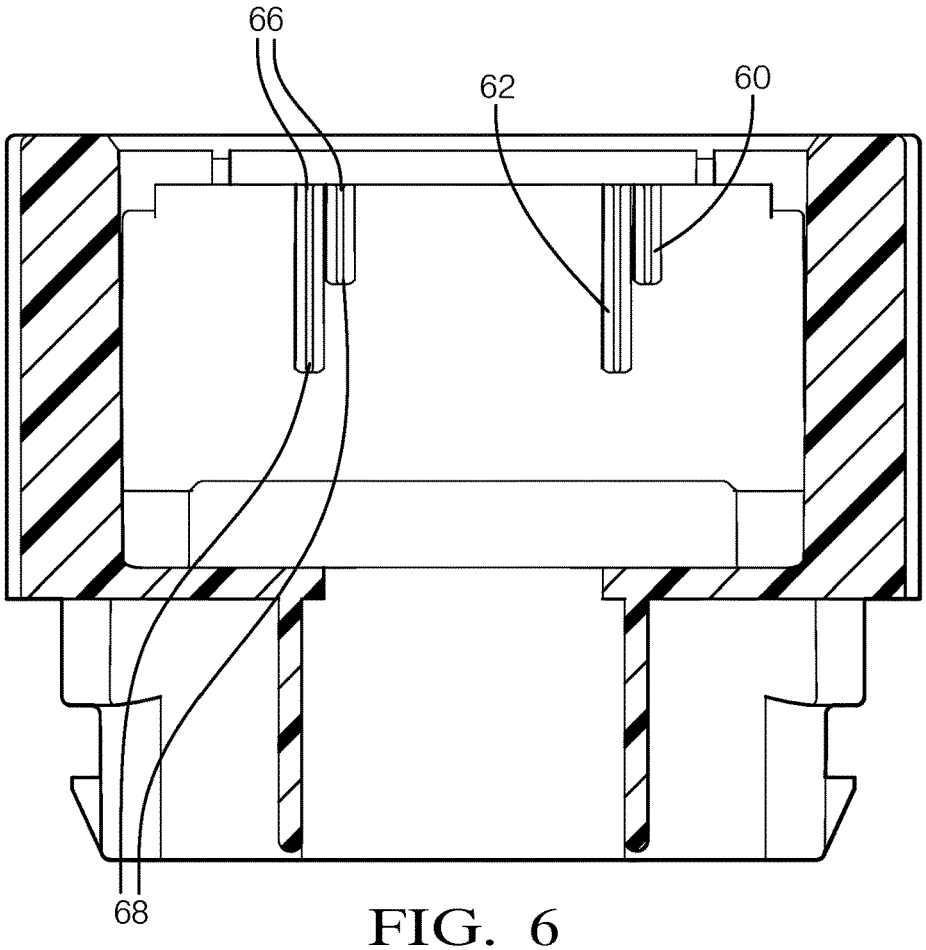
FIG. 6 is another section view of the connector-housing of the connector-assembly of FIG. 1 in accordance with one embodiment.
Figure 7A:
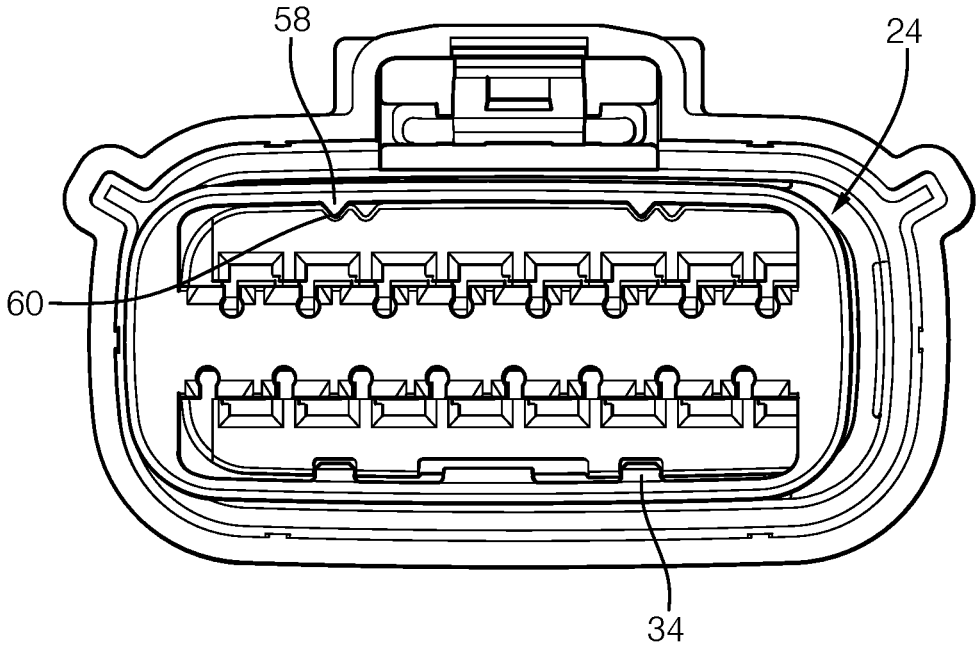
FIG. 7A is a terminal-end view of the connector-housing and the primary-lock-reinforcement device of FIG. 4A in accordance with one embodiment.
Figure 7B:
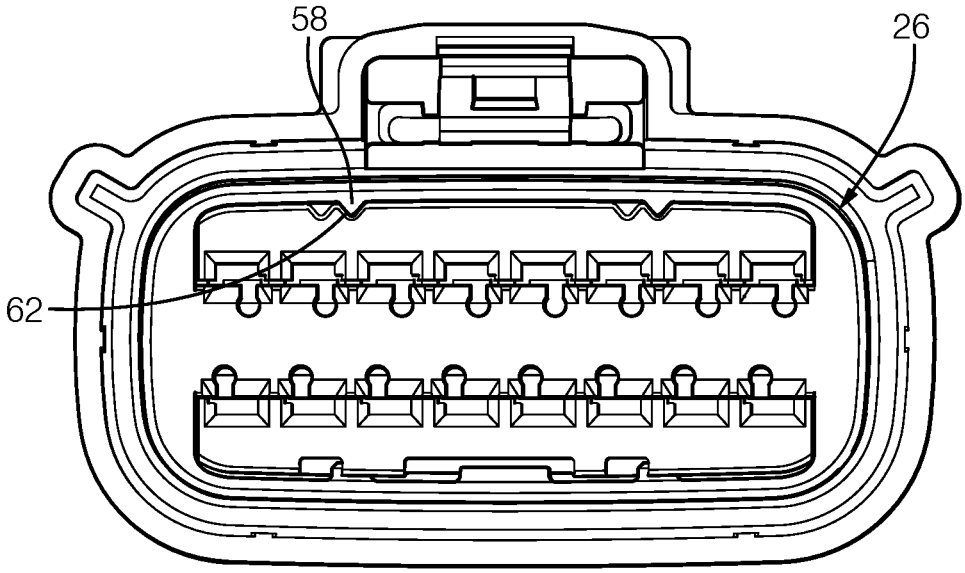
FIG. 7B is a terminal-end view of the connector-housing and the primary-lock-reinforcement device of FIG. 4B in accordance with one embodiment.

Referring back to FIG. 2B, the PLR-device 22 further includes a rib 58 extending beyond the inner-surface 36 of the skirt 30 parallel to the mating-axis 14. The rib 58 is disposed in a corresponding first-groove 60 defined by the outer-surface 40 of the terminal-tower 20 (located on an opposite side of the terminal-tower 20 from the L-shaped slot 38) as illustrated in FIG. 6. When the PLR-device 22 is moved from the shipping-position 24 to the pre-stage position 26, the rib 58 on the PLR-device 22 is disposed into (i.e. moved into) a corresponding second-groove 62, thereby providing a vibratory-feedback to an assembler (see FIG. 7B). The vibratory-feedback has the technical benefit of alerting the assembler that the PLR-device 22 is in the pre-stage position 26. In the examples illustrated in FIG. 2B and FIG. 6, the PLR-device 22 includes a plurality of ribs 58 disposed in a plurality of first-grooves 60 and a plurality of second-grooves 62. The ribs 58 may have a generally V-shape (see FIG. 2B), or have a generally rounded-shape. Referring back to FIG. 6, the first-groove 60 and the second-groove 62 are characterized by an open-end 66 and a closed-end 68. The open-end 66 receives the rib 58 of the PLR-device 22 during an assembly operation, and the closed-end 68 inhibits movement of the PLR-device 22 along the mating-axis 14.

Figure 5:
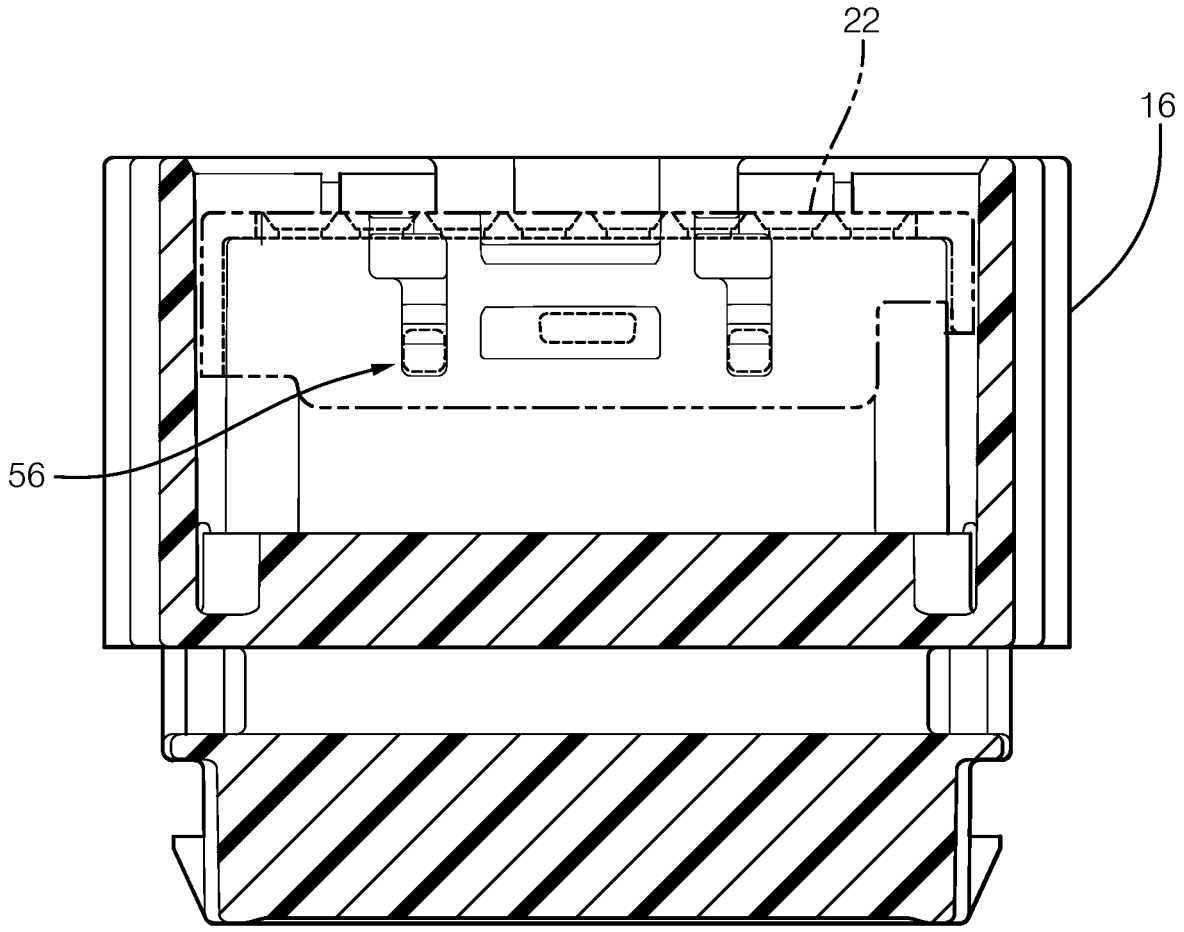
FIG. 5 is yet another section view of the connector-housing and the primary-lock-reinforcement device of FIG. 1 in accordance with one embodiment.
Figure 8:
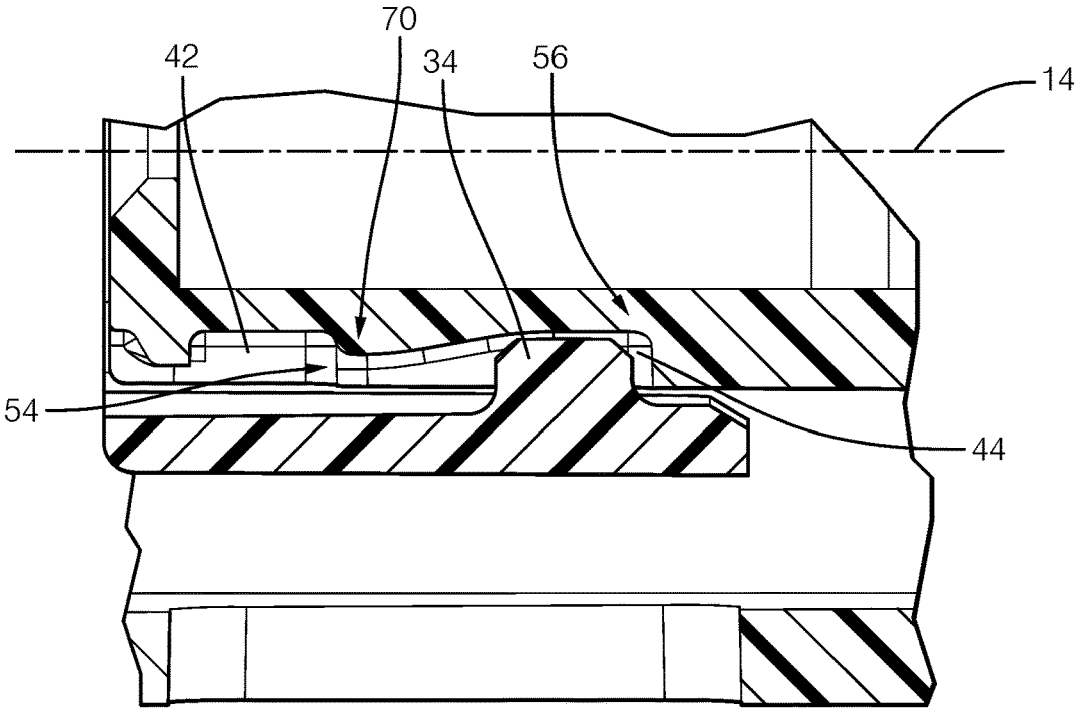
FIG. 8 is a section view of a portion of the connector-housing and the primary-lock-reinforcement device of FIG. 5 in accordance with one embodiment.

FIG. 8 is a section view along the mating-axis 14 of a portion of the connector-housing 16 and the PLR-device 22 of FIG. 5 in the full-stage position 56. The second-leg 44 of the L-shaped slot 38 includes an inertial-detent 70 positioned at the entrance 54 to the second-leg 44, whereby another vibratory-feedback is provided to the assembler as the post 34 travels over the inertial-detent 70 when the PLR-device 22 is moved from the pre-stage position 26 to the full-stage position 56. This vibratory-feedback is has the technical benefit of alerting the assembler that the PLR-device 22 is in the full-stage position 56.

Referring again to FIG. 2B, the PLR-device 22 further includes a locking-tab 72 extending beyond the inner-surface 36 of the skirt 30. The locking-tab 72 is slideably-disposed within a first-locking-trough 74 defined by the outer-surface 40 of the terminal-tower 20 when the PLR-device 22 is in the shipping-position 24 (see FIG. 4A). The first-locking-trough 74 is configured to enable the PLR-device 22 to move in the lateral-direction 52 between the shipping-position 24 and the pre-stage position 26.

Referring back to FIG. 5, the locking-tab 72 is disposed within a second-locking-trough 76 defined by the outer-surface 40 of the terminal-tower 20 when the PLR-device 22 is moved from the pre-stage position 26 to the full-stage position 56, and also provides the assembler with yet another vibratory-feedback indicating that the PLR-device 22 is in the full-stage position 56.

Referring again to FIGS. 4A-4B, the base 28 of the PLR-device 22 includes a beam 78 extending beyond the base 28 parallel with the skirt 30. The beam 78 engages a shoulder 80 defined by the terminal-tower 20 such that the PLR-device 22 is inhibited from moving along the mating-axis 14 when the PLR-device 22 is in the shipping-position 24. The skirt 30 also defines a leading-edge 82 opposite the beam 78 that engages the shoulder 80 on the opposite side of the terminal-tower 20 such that the PLR-device 22 is also inhibited from moving along the mating-axis 14 when the PLR-device 22 is in the shipping-position 24. A lateral-force 84 applied to the PLR-device 22 of between about 30-Newtons and about 45-Newtons is required to move the PLR-device 22 from the shipping-position 24 to the pre-stage position 26. It will be appreciated that the PLR-device 22 must be in either the shipping-position 24 or the pre-stage position 26 before inserting the terminals 12 into the terminal-cavities 18. It will also be appreciated that if the PLR-device 22 is inadvertently moved to the full-stage position 56, as can result during shipping and handling, the assembler will be inhibited from fully inserting the terminals 12 into the connector-housing 16.

A longitudinal-force 86 applied to the PLR-device 22 of between about 20-Newtons and about 45-Newtons is required to move the PLR-device 22 from the pre-stage position 26 to the full-stage position 56 when the terminals 12 are fully seated in the terminal-cavities 18. When the terminals 12 are not fully seated in the terminal-cavities 18, the longitudinal-force 86 applied to the PLR-device 22 of greater than or equal to 60-Newtons is required to move the PLR-device 22 from the pre-stage position 26 to the full-stage position 56. In another embodiment, the longitudinal-force 86 required to move the PLR-device 22 from the pre-stage position 26 to the full-stage position 56 (when the terminals 12 are not fully seated in the terminal-cavities 18) is twice the measured value of longitudinal-force 86 required to move the PLR-device 22 from the pre-stage position 26 to the full-stage position 56 when the terminals 12 are fully seated, providing a sufficient contrast in the required longitudinal-force 86 for the assembler to differentiate between seated and non-seated terminals 12.

Accordingly, a connector-assembly 10 is provided. The connector-assembly 10 is an improvement over prior art connector-assemblies because the connector-assembly 10 includes the PLR-device 22 that resists movement from the shipping-position 24 until a lateral-force 84 is applied to the PLR-device 22.

While this invention has been described in terms of the preferred embodiments thereof, it is not intended to be so limited, but rather only to the extent set forth in the claims that follow. "One or more" includes a function being performed by one element, a function being performed by more than one element, e.g., in a distributed fashion, several functions being performed by one element, several functions being performed by several elements, or any combination of the above. It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact. The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context. Directional terms such as top, bottom, upper, lower, left, right, front, rear, etc. do not denote any particular orientation, but rather these directional terms are used to distinguish one element from another and establish a relationship between the various elements.

We claim:

1. A connector-assembly, comprising:

a connector-housing configured to retain one or more electrical-terminals within one or more terminal-cavities defined by a terminal-tower disposed within the connector-housing, the one or more electrical-terminals configured to mate with one or more corresponding electrical-terminals along a mating-axis of the connector-assembly; and a primary-lock-reinforcement device configured to slideably engage the terminal-tower; the primary-lock-reinforcement device moveable from a shipping-position to a pre-stage-position;

the primary-lock-reinforcement device having a base and a skirt;

the base defining one or more apertures through which the one or more corresponding electrical-terminals pass;

the primary-lock-reinforcement device having a post extending beyond an inner-surface of the skirt;

the post configured to engage a corresponding L-shaped slot defined by an outer-surface of the terminal-tower.

2. The connector-assembly in accordance with claim 1, wherein the corresponding L-shaped slot has a first-leg and a second-leg.

3. The connector-assembly in accordance with claim 2, wherein the first-leg defines a stop configured to inhibit a removal of the primary-lock-reinforcement device from the terminal-tower when the primary-lock-reinforcement device is in the shipping-position.

4. The connector-assembly in accordance with claim 2, wherein the first-leg further defines a wall configured to inhibit a movement of the primary-lock-reinforcement device along the mating-axis.

5. The connector-assembly in accordance with claim 2, wherein when the primary-lock-reinforcement device is moved from the shipping-position to the pre-stage-position, the post aligns with an entrance to the second-leg, thereby enabling the primary-lock-reinforcement device to move from the pre-stage-position to a full-stage-position.

6. The connector-assembly in accordance with claim 1, wherein the primary-lock-reinforcement device includes a plurality of posts configured to engage a plurality of corresponding L-shaped slots.

7. The connector-assembly in accordance with claim 1, wherein the primary-lock-reinforcement device further includes a rib extending beyond the inner-surface of the skirt parallel to the mating-axis, the rib disposed in a corresponding first-groove defined by the outer-surface of the terminal-tower, wherein when the primary-lock-reinforcement device is moved from the shipping-position to the pre-stage-position the rib is disposed into a corresponding second-groove, thereby providing a vibratory-feedback to an assembler.

8. The connector-assembly in accordance with claim 7, wherein the primary-lock-reinforcement device includes a plurality of ribs disposed in a plurality of corresponding grooves.

9. The connector-assembly in accordance with claim 7, wherein the primary-lock-reinforcement device includes a plurality of ribs disposed in a plurality of corresponding grooves.

10. The connector-assembly in accordance with claim 7, wherein the rib has a generally V-shape.

11. The connector-assembly in accordance with claim 7, wherein the rib has a generally rounded-shape.

12. The connector-assembly in accordance with claim 7, wherein the corresponding first-groove and the corresponding second-groove are characterized by an open-end and a closed-end, the close-end inhibiting movement of the primary-lock-reinforcement device along the mating-axis.

13. The connector-assembly in accordance with claim 1, wherein a second-leg of the corresponding L-shaped slot includes an inertial-detent positioned at an entrance to the second-leg, whereby a vibratory-feedback is provided to an assembler as the post travels over the inertial-detent when the primary-lock-reinforcement device is moved from the pre-stage-position to a full-stage-position.

14. The connector-assembly in accordance with claim 1, wherein the primary-lock-reinforcement device further includes a locking-tab extending beyond the inner-surface of the skirt, the locking-tab slideably-disposed within a first-locking-trough defined by the outer-surface of the terminal-tower when the primary-lock-reinforcement device is in the shipping-position, the first-locking-trough configured to enable the primary-lock-reinforcement device to move in a lateral-direction between the shipping-position and the pre-stage-position.

15. The connector-assembly in accordance with claim 14, wherein the locking-tab is disposed within a second-locking-trough defined by the outer-surface of the terminal-tower when the primary-lock-reinforcement device is moved from the pre-stage-position to a full-stage-position.

16. The connector-assembly in accordance with claim 1, wherein the skirt of the primary-lock-reinforcement device defines a leading-edge, the leading-edge engaging a shoulder defined by the terminal-tower such that the primary-lock-reinforcement device is inhibited from moving along the mating-axis when the primary-lock-reinforcement device is in the shipping-position.

17. The connector-assembly in accordance with claim 1, wherein the base of the primary-lock-reinforcement device includes a beam extending beyond the base parallel with the skirt, the beam engaging a shoulder defined by the terminal-tower such that the primary-lock-reinforcement device is inhibited from moving along the mating-axis when the primary-lock-reinforcement device is in the shipping-position.

18. The connector-assembly in accordance with claim 1, wherein a lateral-force applied to the primary-lock-reinforcement device of between about 30-Newtons and about 45-Newtons is required to move the primary-lock-reinforcement device from the shipping-position to the pre-stage-position.

19. The connector-assembly in accordance with claim 1, wherein a longitudinal-force applied to the primary-lock-reinforcement device of between about 20-Newtons and about 45-Newtons is required to move the primary-lock-reinforcement device from the pre-stage-position to a full-stage-position when the one or more electrical-terminals are seated in the one or more terminal-cavities.

20. The connector-assembly in accordance with claim 1, wherein a longitudinal-force applied to the primary-lock-reinforcement device of greater than or equal to 60-Newtons is required to move the primary-lock-reinforcement device from the pre-stage-position to a full-stage-position when the one or more electrical-terminals are not seated in the one or more terminal-cavities.

21. The connector-assembly in accordance with claim 1, wherein the post has a generally square-shape.

22. The connector-assembly in accordance with claim 1, wherein the post has a generally cylindrical-shape.

* * * * *